US005098315A

United States Patent [19]

Scowen

[11] Patent Number: 5,098,315

[45] Date of Patent: Mar. 24, 1992

[54] SEAL RETAINER FOR ELECTRICAL CONNECTORS

[75] Inventor: Kenneth J. Scowen, Springfield, N.J.

[73] Assignee: Dill Products Incorporated, Norristown, Pa.

[21] Appl. No.: 610,802

[22] Filed: Nov. 8, 1990

[51] Int. Cl.[5] ..... H01R 13/42; H01R 13/424

[52] U.S. Cl. ..... 439/587; 439/589; 439/752

[58] Field of Search ..... 439/587-589, 439/372, 592, 594, 599, 603, 752

[56] References Cited

U.S. PATENT DOCUMENTS 4,621,883 11/1986 Noguchi ..... 439/752
4,804,343 2/1989 Reedy ..... 439/587
4,973,266 11/1990 Bullard ..... 439/589

*Primary Examiner*—Paula A. Bradley

*Attorney, Agent, or Firm*—Synnestvedt & Lechner

[57] ABSTRACT

Seal retainers for electrical connectors. The seal retainers described herein comprise a retainer plate having one or more slots therein to accommodate a wire or wires leading into a connector. In the retaining position, the retainer plate extends across the connector cavities with the wires passing through the retainer plate slots. A seal and/or secondary lock disposed around the wire in the connector cavities are engaged by the interface of the retainer plate to prevent outward axial movement thereof from the cavities. The retainer plate includes a peripheral flange which fits into a peripheral recess of the connector body and thus lies flush with the connector body surfaces. At least one dovetail tab extends axially from each side of said retainer, said tabs extending from said retainer plate flange. Dovetail recesses in the container body are aligned to receive said dovetail retainer tabs.

16 Claims, 2 Drawing Sheets

SEAL RETAINER FOR ELECTRICAL CONNECTORS

BACKGROUND OF THE INVENTION

The present invention relates generally to electrical connectors and relates more particularly to an improved seal and/or secondary lock retainer for electrical connectors.

The typical in-line electrical connector comprises a molded plastic connector body having at least one cavity into which a terminal with attached wire is inserted to a predetermined seated position. The terminal conventionally includes a primary lock such as a tang which cooperates with an element of the body cavity, such as a shoulder, to prevent withdrawal of the wire and terminal from the connector body. It is also conventional to have a seal disposed around the wire with a retainer to secure the seal in place.

In some connectors, a secondary lock is employed to prevent relative movement of the terminal and connector body in case of primary lock failure. In one commercially available connector, the seal and secondary lock are embodied in a unitary insert which is held in place by a retainer.

Various types of retainer arrangements have been utilized for connector seals and/or secondary locks, conventional retainers usually being either of the integrally molded hinged variety or of the separate clip type, both types including some form of detent or latching mechanism to secure the retainer in a closed position. With either type, there is the possibility during assembly that the retainer may not be completely closed so as to secure its detent or latching mechanism. Such an incomplete assembly can be difficult to detect on inspection, since the positional difference between a latched and unlatched condition of the retainer may be so small as to be unnoticeable. With most conventional retainer structures, the failure to properly lock the retainer vitiates its operation. Since electrical connectors are often used for vital circuits, particularly in automotive uses, it is of critical importance that the seal and/or secondary lock retainer be of a design which during assembly cannot be left in an ambiguous "almost latched" position. Furthermore, it is important that inspection of the retainer, preferably both by sight and touch, can readily confirm its correctly latched condition.

SUMMARY OF THE INVENTION

The retainer of the present invention comprises a retainer plate having one or more slots therein to accommodate the wire or wires leading into a connector. In its retaining position, the retainer plate extends across the connector cavities with the wires passing through the retainer plate slots. The seal and/or secondary lock disposed around the wire in the connector cavities are engaged by the inner face of the retainer plate to prevent outward axial movement thereof from the cavities. The retainer plate includes a peripheral flange which fits into a peripheral recess of the connector body and thus lies flush with the connector body surfaces. At least one dovetail tab extends axially from each side of said retainer, said tabs extending from said retainer plate flange. Dovetail recesses in the container body are aligned to receive said retainer tabs. Beveled ramps at the entrance of each dovetail recess resiliently displace each tab outwardly upon assembly of the retainer, resulting in an audible snapping noise as the tabs drop into the recesses. The tabs lie flush with the surface of the connector body in the assembled condition of the retainer, and this flush condition can be seen as well as felt to positively confirm that the retainer is locked in place in addition to the audible signal.

It is accordingly a primary object of the invention to provide a locking mechanism for an electrical connector seal and/or secondary lock retainer, the locked condition of which can be confirmed by sight, sound and touch upon assembly.

Another object of the invention is to provide a locking mechanism as described which upon locking does not retract and hence does not allow any play of the secured seal and/or secondary lock.

A further object of the invention is to provide a locking mechanism as described which lies flush with the surface of the connector in its locked condition and accordingly cannot be inadvertently released by engagement with adjacent wires or other equipment components.

Still another object of the invention is to provide a locking mechanism as described which by presenting a smooth, flush connector surface is user friendly and will not catch in other wires, or the user's hands or clothing.

An additional object of the invention is to provide a locking mechanism as described which can be readily released without special tools.

A still further object of the invention is to provide a locking mechanism as described which is structurally simple and hence inexpensive to manufacture.

Additional objects and advantages of the invention will be more readily apparent from the following detailed description of an embodiment thereof when taken together with the accompanying drawings.

DESCRIPTION OF THE PREFERRED EMBODIMENT

Figure 11:
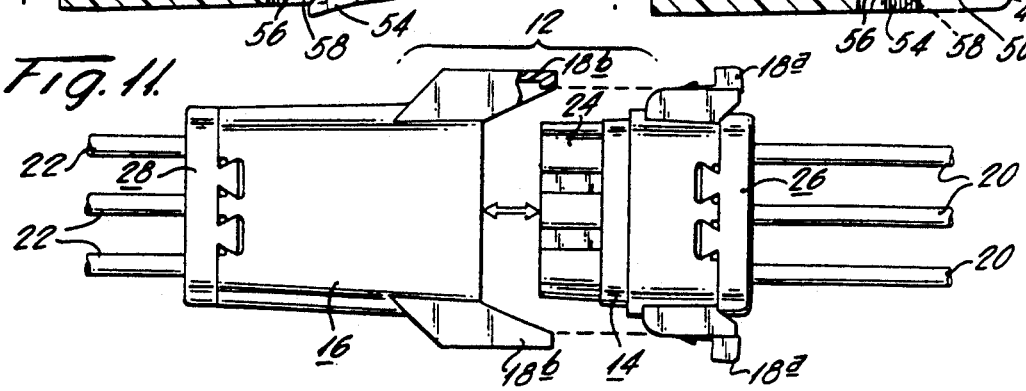
FIG. 11 is a plan view showing the separated halves of an electrical connector assembly equipped with retainers in accordance with the invention.

Referring to the drawings and particularly FIG. 11 thereof, an electrical connector assembly generally designated 12 includes a male connector 14 and female connector 16 which are secured when joined together by a latching mechanism components 18*a* and 18*b* respectively disposed on the connectors 14 and 16. Although a connector of this type could be used to join any desired number of wires, in the example illustrated, three wires 20 are joined by the connector assembly 12 to three wires 22. In the coupled condition of the connector assembly, a male portion 24 of the connector 14 telescopes within a cavity in the connector 16 to join the wire terminals. As is well known in this type of connector, the female terminals are disposed within the male portion 24 of the connector 14, whereas the male terminals are concealed within the cavity of the female connector 16. The connectors 14 and 16 are each provided with combination seals and secondary locks to seal and secure the wire terminals within the connector bodies. Seal and secondary lock retainers 26 and 28, which are identical in construction, are respectively provided for association with the connectors 14 and 16 in accordance with the present invention. Since the retainers 26 and 28 and their manner of attachment to the connectors 14 and 16 are identical, only the connector 14 and its retainer 26 are described below in detail.

Figure 3:
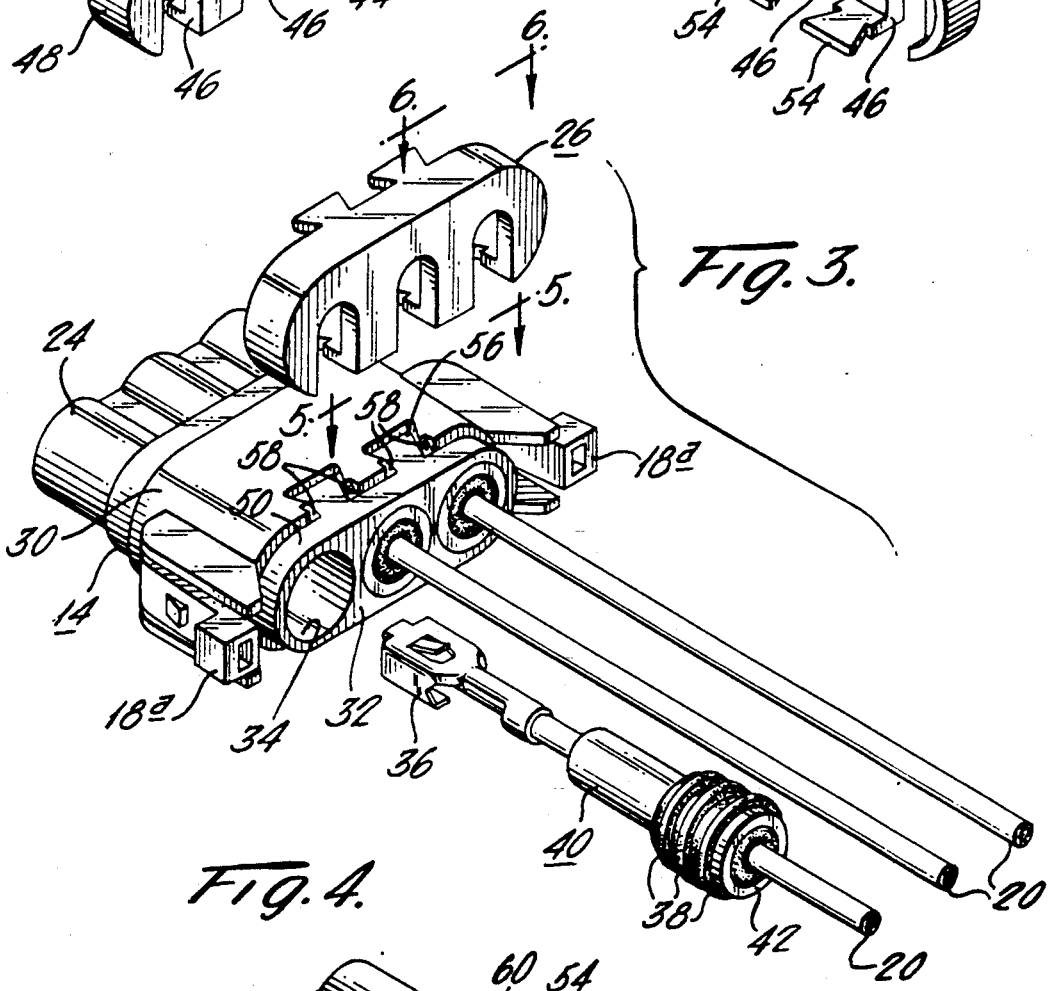
FIG. 3 is an exploded perspective view showing the components of an electrical connector assembly incorporating a connector body, terminal equipped wires, combination secondary locks and seals, and the retainer shown in FIGS. 1 and 2.

As shown in FIG. 3, the connector 14 comprises a connector body 30 of a generally oval cross section, from one end of which extends the male portion 24. The other end 32 of the connector body 30 is substantially planar and is interrupted by a plurality of cavities 34 into which pass the wires 20 having terminals 36 attached at their ends. The cavities 34 are configured in a well known manner to receive the female terminals 36 of the wires 20 in a particular orientation within the portion 24 to provide alignment and interengagement with the corresponding male terminals of the connector 16 upon coupling of the two connectors 14 and 16.

The outermost portions of the cavities 34 are substantially cylindrical to receive the resilient seal rings 38 of the combination secondary lock and seals 40, one of which is provided around each wire adjacent the terminal. The secondary lock and seal 40 shown on the lowermost wire 20 of FIG. 3 will, upon seating of the terminal in the connector body, be slid along the wire into engagement with the terminal. This type of secondary lock and seal is the subject of commonly assigned Bullard U.S. Pat. No. 4,973,266, "Combined Terminal Secondary Lock and Seal," issued Nov. 27, 1990 and the details of its construction and its cooperative function with the terminal 36 and connector body cavity is fully described in that application which is hereby incorporated by reference. In the seated position of the secondary lock and seal 40, the outer end 42 thereof is disposed flush with the outer end 32 of the connector body. It is the function of the retainer 26 of the present invention to prevent outward movement of each of the secondary lock and seals 40 from their respective cavities 34.

Figure 4:
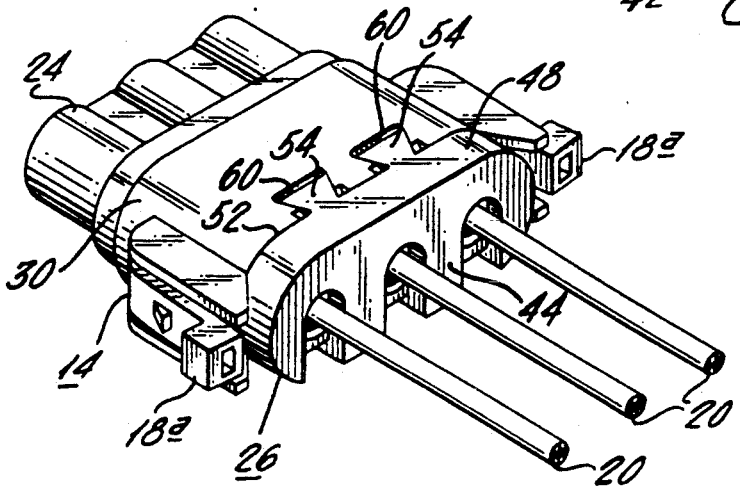
FIG. 4 is a view of the elements shown in FIG. 3 in the assembled condition.

The retainer 26 comprises a plate 44 of a size and shape essentially the same as that of the end 32 of the connector body. The plate 44 comprises a plurality of transverse slots 46 therein aligned with the cavities 34 and of sufficient size to permit passage of the wires 20 extending from the cavities. The retainer 26 includes a peripheral flange 48 extending inwardly from the plate 44, which flange is also interrupted by the slots 46. The connector body 30 is provided with a peripheral recess 50 of a depth substantially the same as the thickness of the flange 48 of the retainer, the flange accordingly seating in close fitting relation around the connector body recess in the assembled condition of the retainer as shown in FIG. 4. The width of the recess similarly is the same as the width of the flange so that the plate 44 will abut the end 32 of the connector body when the edge of the flange 48 abuts the edge of the recess 50 as shown at 52 in FIG. 4.

Figure 1:
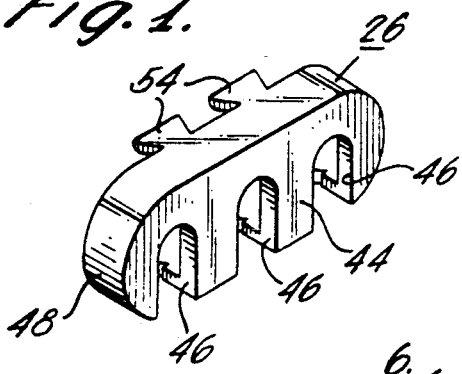
FIG. 1 is a perspective view of a retainer in accordance with the present invention.
Figure 2:
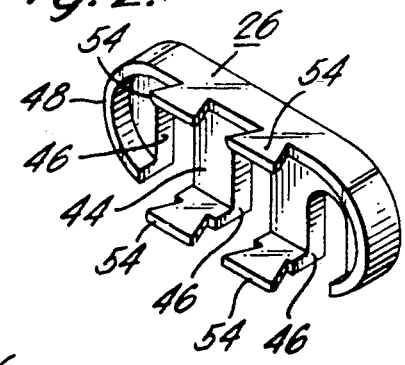
FIG. 2 is another perspective view of the retainer of FIG. 1 taken from a different angle.

Means are provided for demountably securing the retainer in place against the end 32 of the connector body 30. This means comprises a plurality of dovetail tabs 54 extending from the flange 48 of the retainer plate 44. There should be at least one tab 54 on each of two opposite sides of the retainer and in the embodiment illustrated, there are two such tabs on opposite sides of the retainer as shown in FIG. 2.

Figure 5:
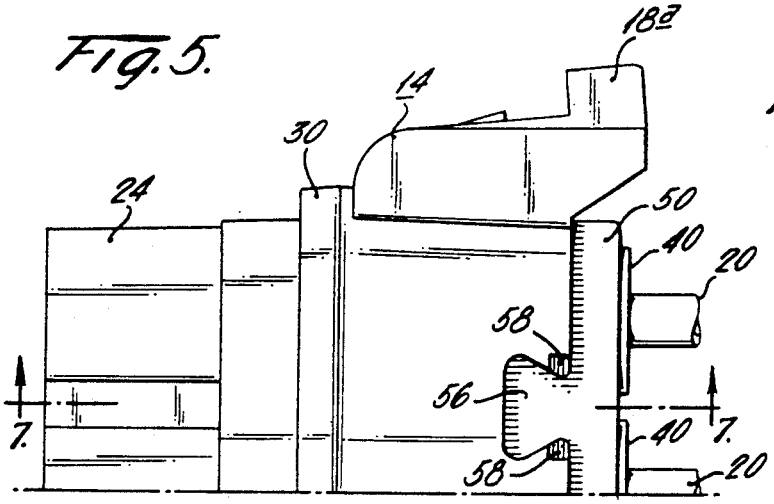
FIG. 5 is an enlarged view taken along line 5—5 of FIG. 3 showing details of the connector body dovetail recess.
Figure 6:
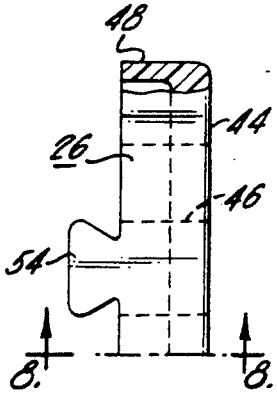
FIG. 6 is an enlarged view taken along line 6—6 of FIG. 3 showing a dovetail tab in detail.
Figure 7:
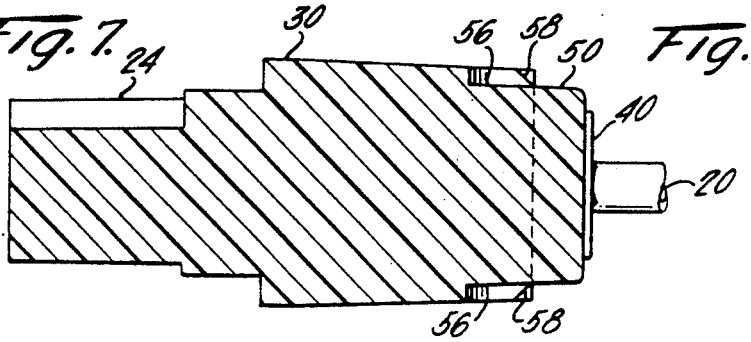
FIG. 7 is a sectional view taken along line 7—7 of FIG. 5.
Figure 8:
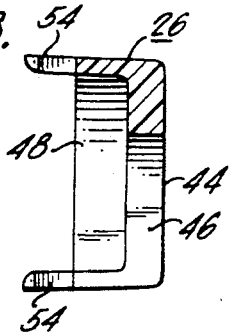
FIG. 8 is a sectional view taken along line 8—8 of FIG. 6.

The tabs 54 cooperatively engage dovetail recesses 56 of the connector body 30 which are of a size and shape to mate snugly with the dovetail tabs 54 when the retainer has reached its seated position with plate 44 disposed against connector body end 32. In order to facilitate the necessary resilient deflection of the dovetail tabs prior to their seating in the recesses, beveled ramps 58 are provided adjacent the entrance of each dovetail recess 56 in the region at which the dovetail recess 56 intersects the peripheral recess 50 of the connector body. The ramps 58 of each dovetail recess have a combined width equal to or slightly greater than the width of the dovetail tabs as can be gained from the enlarged view of FIG. 5. The permits the wider outer end of each dovetail tab to smoothly enter into a position over the dovetail recess by a gradual deformation thereof such that when the tab reaches its entry position it will snap audibly into a locking disposition within the recess. Accordingly, the seated and locked position of the retainer on the connector body will be evident in three ways, by the audible signal of the tabs snapping in place, by the visual conformation of the tabs in flush relationship with the connector body 30, and by the feeling of the flush disposition of the tabs with the body. It would thus be virtually impossible with the present retainer to assemble the connector with the retainer in an unlatched condition.

In order to permit the removal of the retainer should be need arise to remove one or more of the wires from the connector, the dovetail recesses are slightly longer than the tabs, resulting in a narrow space 60 between the end of each tab and the end of each recess as shown in FIG. 4. The insertion of any suitably sized object such as a screwdriver, knife or even a paper clip in this space can effect a raising of the tab from the recess. By raising each of the tabs on one side of the retainer, the retainer can be rotated from the connector body to thereby release the opposed tabs and hence permit the separation of the retainer from the body. Due to the resilient nature of the plastic material from which the connector body and retainer is made, preferably glass-filled nylon, the retainer may be applied to and removed from the connector body any number of times without affecting its locking capabilities.

Figure 9:
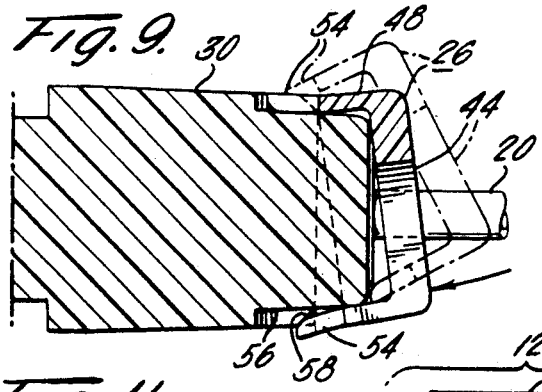
FIG. 9 is a view similar to FIG. 7 and showing the manner of attachment of the retainer to the connector body.
Figure 10:
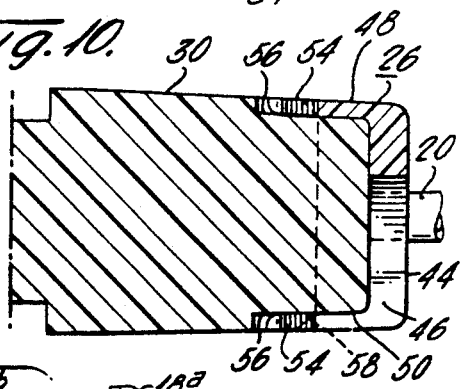
FIG. 10 is a view similar to FIG. 9 with the retainer latched in position on the connector body.

The assembly of the connector employing the present seal retainer is relatively simple. As shown in FIG. 3, the wires bearing the terminals at their ends are inserted into the connector body to seat the terminals and engage the terminal primary locks. The combination secondary locks and seals are slid into position on the wires and when seated lie flush with the end of the connector body. The retainer is then positioned over the wires with the slots accommodating the wires in the manner shown in FIG. 9. As indicated in broken lines in that view, the retainer may most readily be attached by seating the dovetail tabs on one side into the dovetail recesses of the connector body, and then rotating the retainer until the tabs on the opposite side snap into their respective recesses. The seated position of the retainer may then be visually and tactiley checked to confirm that the audible snapping of the tabs did indeed seat the retainer tabs in the recesses. An unseated condition of any tab will be immediately obvious by touch and by sight since the tab will be sticking up at an angle and will thus be conspicuously unlatched. Such a condition may be quickly rectified by applying pressure to the retainer plate to urge the tab over and into the recess.

As can be appreciated from the drawing views, the assembled retainer and connector body provide a flush profile which is both pleasing in appearance as well as functionally desirable insomuch as the tabs cannot become entangled in adjacent wires or other structures and inadvertently unlatched. The retainer structure is light weight, and quite simple to fabricate in a plastic molding process.

Although the connector body in connection with which the invention has been described has comprised one half of a wire-to-wire connector assembly, it will be apparent that the connector body incorporating the invention could also be one joining a wire to a junction block, terminal strip or the like. The invention accordingly is not limited in use to wire-to-wire connectors, although this is its primary expected usage.

Manifestly, changes in details of construction can be effected by those skilled in the art without departing from the invention.

I claim:

1. In combination, a connector body having at least one cavity for receiving a wire with a seal disposed around said wire, a seal retainer, said retainer comprising a retainer plate having at least one slot therein, said plate being adapted for disposition against said connector body over said cavity for engagement with the wire seal and with the wire extending through said slot so that a peripheral flange extending inwardly from the plate substantially abuts an end of the connector body when said seal retainer is disposed against said connector body over said cavity for engagement with the wire seal, and means for demountably securing said retainer in place, said means comprising at least one dovetail tab extending from each of two opposed sides of said retainer plate, and dovetail recesses on said connector body aligned with said tabs for receiving said tabs in locking engagement, said dovetail tab having a wider outer end adapted to engage said recesses by a gradual deformation of the wide outer end when the dovetail tab is placed in position over the recesses.

2. The invention as claimed in claim 1, wherein the lengths of said dovetail recesses are greater than the lengths of said tabs to provide a space between the ends of the tabs and ends of the recesses in the assembled condition of the body and retainer sufficient to permit the insertion of an object to lift the tabs from the recesses.

3. The invention as claimed in claim 1, wherein said connector body and said retainer are formed of a molded plastic material.

4. The invention as claimed in claim 1, including beveled ramps at the entrance of each said dovetail recess to facilitate entry of said tabs into said recesses.

5. The invention as claimed in claim 4, wherein the distance between the ramp side edges for each recess is equal to or greater than the width of the dovetail tab associated with that recess.

6. The invention as claimed in claim 1, wherein said dovetail tabs extend from said peripheral flange.

7. The invention as claimed in claim 6, including a peripheral recess on said connector body adapted to receive said peripheral flange whereby said peripheral flange lies in flush disposition with said retainer body upon connection of the retainer thereto.

8. The invention as claimed in claim 6, wherein said tabs comprise an extension of said peripheral flange, and wherein said dovetail recesses comprise an extension of said connector body recess, whereby said tabs seat in flush relation with said connector body in said dovetail recesses.

9. In combination, a connector body having a plurality of cavities in one end thereof, a plurality of wires, each said wire having a terminal attached to one end thereof, the terminal end of each said wire being disposed within a cavity of said connector, a secondary lock and seal disposed around each said wire, each said secondary lock and seal being disposed entirely within one of said cavities in flush relation with said end of said retainer body, a secondary lock and seal retainer, said retainer comprising a retainer plate having a plurality of slots therein, said plate being adapted for disposition against said connector body end over said cavities for engagement with said secondary lock and seal and with said wires extending through said slots, so that a peripheral flange extending inwardly from the plate substantially abuts an end of the connector body when said seal retainer is disposed against said connector body over said cavity for engagement with said secondary lock and seal, and means for demountably securing said retainer in place, said means comprising at least one dovetail tab extending from each of two opposed sides of said retainer plate, and dovetail recesses on said connector body aligned with said tabs for receiving said tabs in locking engagement, said dovetail tab having a wide outer end adapted to engage said recesses by a gradual deformation of the wide outer end when the dovetail tab is placed in position over the recesses.

10. The invention as claimed in claim 9, wherein the lengths of said dovetail recesses are greater than the lengths of said tabs to provide a space between the ends of the tabs and ends of the recesses in the assembled condition of the body and retainer sufficient to permit the insertion of an object to lift the tabs from the recesses.

11. The invention as claimed in claim 9, wherein said connector body and said retainer are formed of a molded plastic material.

12. The invention as claimed in claim 9, including beveled ramps at the entrance of each said dovetail recess to facilitate entry of said tabs into said recesses.

13. The invention as claimed in claim 12, wherein the distance between the ramp side edges for each recess is equal to or greater than the width of the dovetail tab associated with that recess.

14. The invention as claimed in claim 9, wherein said dovetail tabs extend from said flange.

15. The invention as claimed in claim 14, including a peripheral recess on said connector body adapted to receive said peripheral flange whereby said peripheral flange lies in flush disposition with said retainer body upon connection of the retainer thereto.

16. The invention as claimed in claim 14, wherein said tabs comprise an extension of said peripheral flange, and wherein said dovetail recesses comprise an extension of said connector body recess, whereby said tabs seat in flush relation with said connector body in said dovetail recesses.

* * * * *